US007976083B2

(12) United States Patent
Black et al.

(10) Patent No.: US 7,976,083 B2
(45) Date of Patent: Jul. 12, 2011

(54) ANIMAL WASTE DISPOSAL SYSTEM

(76) Inventors: Joseph D. Black, Staten Island, NY (US); Andrew J. Mistler, III, W. Babylon, NY (US)

( * ) Notice: Subject to any disclaimer, the term of this patent is extended or adjusted under 35 U.S.C. 154(b) by 0 days.

(21) Appl. No.: 12/144,143

(22) Filed: Jun. 23, 2008

(65) Prior Publication Data

US 2009/0315349 A1 Dec. 24, 2009

(51) Int. Cl.
*A01K 29/00* (2006.01)

(52) U.S. Cl. ..... 294/1.3; 294/25

(58) Field of Classification Search ..... 294/1.3, 294/25, 99.2; 15/257.1, 257.6; 383/1; 229/111, 229/112

See application file for complete search history.

(56) References Cited

U.S. PATENT DOCUMENTS

| | | | | | |
|---|---|---|---|---|---|
| 3,178,092 | A | * | 4/1965 | Munana et al. | 229/112 |
| 3,703,158 | A | | 11/1972 | Lemler | |
| 3,813,121 | A | * | 5/1974 | Marvin | 294/1.3 |
| 3,841,684 | A | * | 10/1974 | Fleishman | 294/1.3 |
| 3,917,333 | A | * | 11/1975 | Grattan | 294/1.3 |
| 3,978,540 | A | | 9/1976 | Peck et al. | |
| 4,002,288 | A | * | 1/1977 | Klupt | 229/112 |
| 4,103,952 | A | | 8/1978 | Thompson | |
| 4,188,055 | A | * | 2/1980 | Green | 294/1.3 |
| 4,245,771 | A | * | 1/1981 | Christian | 229/112 |
| 4,458,932 | A | | 7/1984 | Resch | |
| 4,747,633 | A | * | 5/1988 | Stacy | 294/1.3 |
| 5,222,777 | A | * | 6/1993 | Clonch | 294/1.3 |
| 5,358,295 | A | * | 10/1994 | Campbell | 294/1.3 |
| 5,400,572 | A | | 3/1995 | Peck et al. | |
| 5,441,017 | A | | 8/1995 | Lindsay | |
| 5,725,268 | A | * | 3/1998 | Besasie et al. | 294/1.3 |
| 6,059,333 | A | * | 5/2000 | De Toma | 294/1.3 |
| 6,086,123 | A | | 7/2000 | Sowinski et al. | |
| 7,216,905 | B1 | * | 5/2007 | Armes, Jr. | 294/1.3 |
| 2005/0194799 | A1 | | 9/2005 | Karimi et al. | |

FOREIGN PATENT DOCUMENTS

| | | | |
|---|---|---|---|
| GB | 2 245 818 | * | 1/1992 |
| GB | 2 250 677 | * | 6/1992 |

* cited by examiner

*Primary Examiner* — Dean J Kramer

(74) *Attorney, Agent, or Firm* — Weitzman Law Offices, LLC

(57) ABSTRACT

An animal waste disposal system, comprising a collection bag having an open end and a closed bottom. A waste removal tool is attached to the closed bottom of the collection bag. The waste removal tool including opposing jaws, with each jaw terminating in a blade portion. The opposing jaws are movable from an open position where the opposing jaws are separated from one another to a closed position where the blade portion of one opposing jaw is in close proximity to the blade portion the other opposing jaw.

12 Claims, 2 Drawing Sheets

ANIMAL WASTE DISPOSAL SYSTEM

FIELD

This application relates generally to collection and removal of animal waste, and more particularly, to an improved, sanitary animal waste disposal system.

BACKGROUND

Animal waste, such as dog feces, is unsightly and offensive to many people in the community. Disputes between neighbors are not uncommon over pet owners leaving their pets' feces in the neighbor's yard.

Many communities and public areas have enacted laws or restrictions that require pet owners to dispose of any feces or other animal waste left behind by their pets. These restrictions are not only for aesthetic and environmental purposes, but also for health reasons. Pet owners are responsible for monitoring and cleaning up after their pets. Animal waste, such as dog feces, is contaminated with bacteria that may be harmful to humans, as well as other animals. This is especially true for people with weak immune systems, such as seniors and infants/toddlers. Therefore, it is important that animal waste be collected and disposed of in a sanitary fashion.

Pet owners, in particular, dog owners, use various devices to dispose of animal waste or feces. The most basic devices used are small shovels and containers, which are cumbersome to carry. Disposable bags have also been uses to collect animal waste, but generally require the pet owner's hand to contact the animal waste through the bag during collection, thereby providing a highly unpleasant tactile sensation for the pet owner. None of these current devices provide a sanitary system that eliminates unpleasant tactile sensation associated with the collection of animal waste.

It is, therefore, desirable to have an animal waste disposal system that allows pet owners to collect animal waste easily without exposing them to harmful bacteria or unpleasant tactile sensations.

SUMMARY

In one aspect of this application, an animal waste disposal system is disclosed, comprising a collection bag having an open end and a closed bottom. A waste removal tool is attached to the closed bottom of the collection bag. The waste removal tool including opposing jaws, with each jaw terminating in a blade portion. The opposing jaws are movable from an open position where the opposing jaws are separated from one another to a closed position where the blade portion of one opposing jaw is in close proximity to the blade portion the other opposing jaw.

In another aspect of this application, an animal waste disposal system is disclosed, comprising a waste removal tool having opposing jaws, with each jaw terminating in a blade portion. The waste removal tool is dimensioned to fit within the palm of a user's hand with the user's fingers extending over one of the jaws and the user's thumb extending over the other jaw. The opposing jaws are movable in response to movement of the user's fingers and thumb from an open position where the jaws are separated from one another to a closed position where the blade portion of one opposing jaw is in close proximity to the blade portion the other opposing jaw.

The foregoing has outlined rather generally the features and technical advantages of one or more embodiments of this disclosure in order that the following detailed description may be better understood. Additional features and advantages of this disclosure will be described hereinafter, which may form the subject of the claims of this application.

DETAILED DESCRIPTION

Preferred animal waste disposal systems are disclosed herein that address many of the shortcomings of existing devices. The preferred systems comprise of a bag, which is preferably made of biodegradable plastic, combined with a manual waste removal tool. The waste removal tool may be inside or external of the bag.

Figure 1:
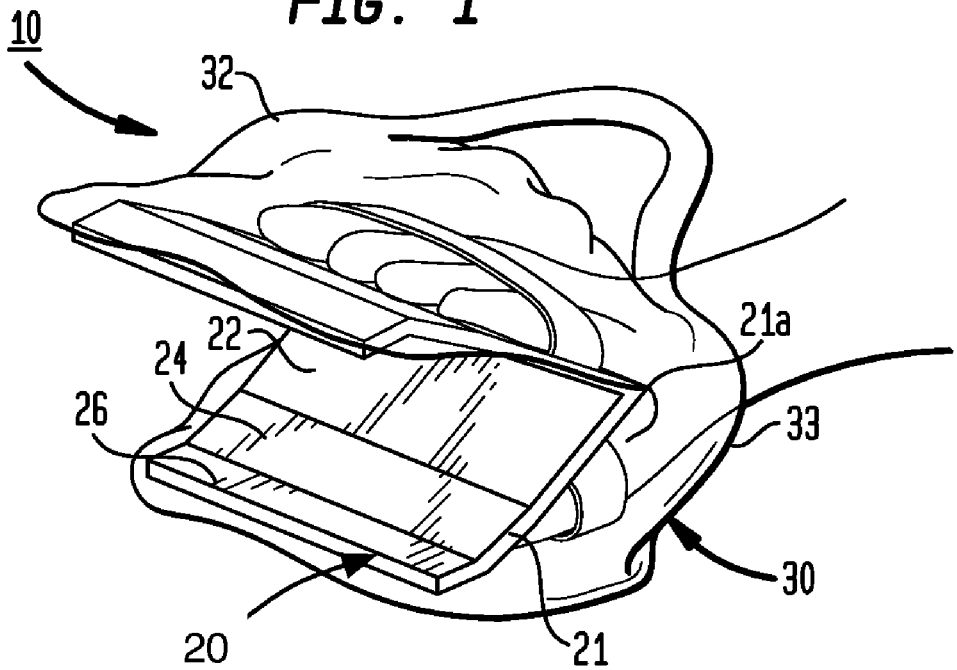
FIG. 1 is a perspective view of an embodiment of an animal waste disposal system in accordance with the present disclosure.
Figure 2:
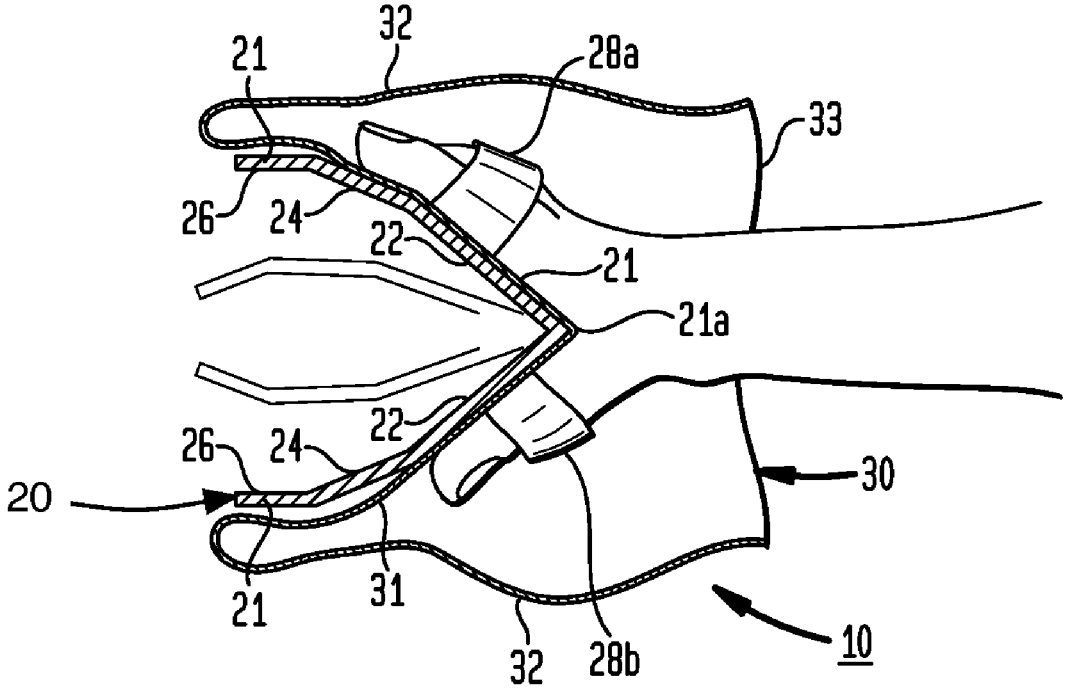
FIG. 2 is a cross-sectional view of the animal waste disposal system of FIG. 1.

FIGS. 1 and 2 disclose a preferred embodiment of an animal waste disposal system 10 that comprises a waste removal tool 20 within a collection bag 30. The collection bag 30 includes a closed end or bottom 31 joined by sidewalls 32. The sidewalls 32 extend from the closed end 31 and terminate at an open end 33 to provide an internal compartment capable of holding animal waste. The collection bag 30 may be made of a thin, flexible sheet of plastic or similar material, preferably a biodegradable plastic material.

The waste removal tool 20 is preferably attached to the interior side of the closed end 31 of the bag 30. The waste removal tool 20 includes two opposing jaws 21 that are joined at one end or fold 21*a* to form a generally V-shaped configuration. Each jaw 21 preferably includes a gripping portion 22 extending from the fold 21*a*, a central or intermediate portion 24 extending from the gripping portion 22, and a blade portion 26 extending from the intermediate portion 24 at the free end of the jaw 21. The jaws 21 may move relative to one another by pivoting or flexing about the fold 21*a*.

The waste removal tool 20 is preferably formed from a single sheet of flexible, semi-rigid material, such as, for example, heavy paper, cardboard, thermoplastic material or the like. Such materials provide a rigid construction that is still flexible and can be scored and folded. When not in use, the waste removal tool 20 and collection bag 30 may be folded together to form a low profile that is easy to carry and to store. The waste removal tool 20 may be attached to the closed end 31 of the bag 30 in a conventional manner, such as, for example, using an adhesive, fasteners, staples or the like.

In use, a user would invert or otherwise turn the collection bag 30 inside out to expose the waste removal tool 20 affixed to the closed end 31 as illustrated in FIGS. 1 and 2. The user would insert a hand into the open end 33 of the inverted collection bag 30 and grasp the gripping portion 22 of the waste removal tool 20 through the bag between the user's fingers and thumb. For ease of use, one or more of the user's fingers may be inserted within a handle or strap 28*a* attached to the gripping portion 22 of one of the jaws 21 and the user's thumb may be inserted within a handle or strap 28*b* attached to the gripping portion 22 of the other jaw 21. The handles 28*a*, 28*b* may be attached to the gripping portion 22 or to the bag 30 in proximity of the gripping portion 22 in a conventional manner, such as, for example, using an adhesive, fasteners, staples or the like.

The user may collect animal waste by opening the user's hand to separate the jaws 21 of the waste removal tool 20 so that the blade portions 26 of the opposing jaws 21 surround the animal waste (as illustrated in solid lines in FIGS. 1 and 2). As the user squeezes the waste removal tool 20 between the user's fingers and thumb, the opposing jaws 21 close or otherwise move closer to one another (as illustrated in the ghost lines in FIG. 2) and the blade portions 26, which turn slightly inward toward one another, urge or otherwise scoop the animal waste further into the waste removal tool 20 as the jaws 21 are moved toward one another.

Once the animal waste is captured between the opposing jaws 21, the collection bag 30 is then returned to its uninverted position to enclose the animal waste within the waste removal tool 20. The open end 33 of the collection bag 30 may then be sealed, tied or otherwise closed so that the bag can be thrown away or otherwise disposed of. Neither the user's hand nor fingers come into contact with the animal waste during collection since the user's hand is protected by the collection bag 30, thereby providing a sanitary means of collecting and disposing of animal waste. Moreover, the user is not exposed to unpleasant tactile senses associated with contacting the animal waste through the bag 30 since the waste is contained within the waste removal tool 20 and does not come into contact with the user's hand.

Figure 3:
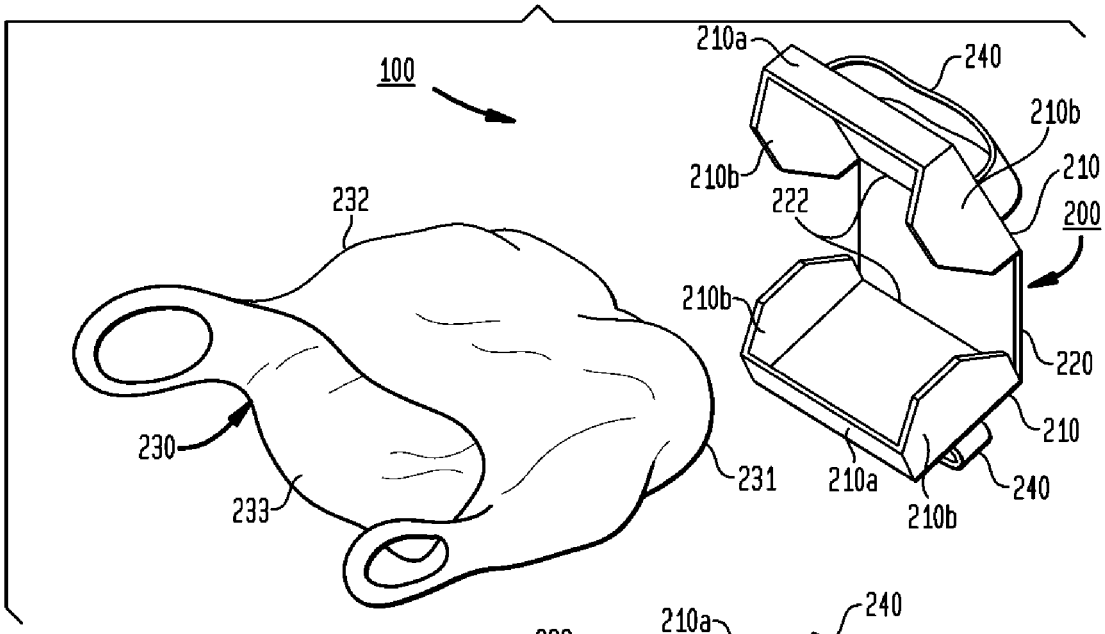
FIG. 3 is a perspective view of another embodiment of an animal waste disposal system in accordance with the present disclosure.
Figure 4:
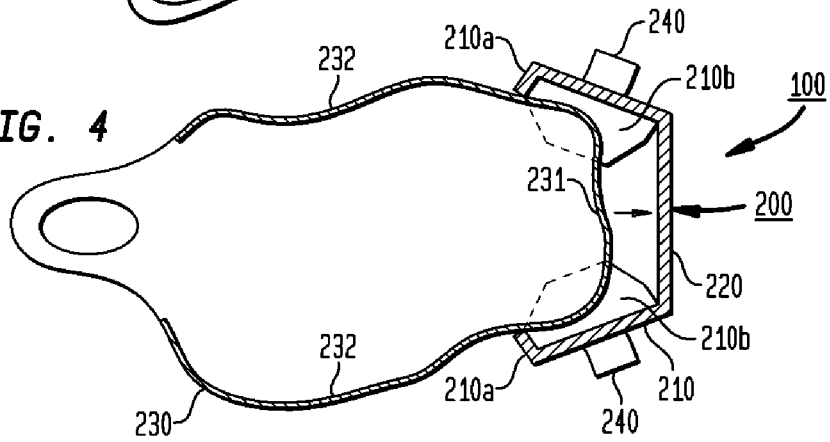
FIG. 4 is a cross-sectional view of the animal waste disposal system of FIG. 4 as the collection bag is being inserted onto the device.
Figure 5:
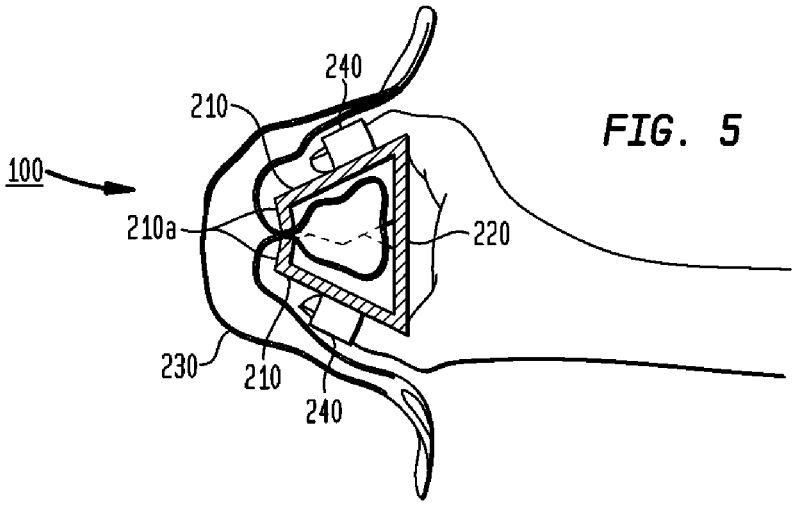
FIG. 5 is a cross-sectional view of the animal waste disposal system of FIG. 4 in a closed position after the collection bag has been placed on the device.

FIGS. 3-5 illustrate another preferred embodiment of the animal waste disposal system 100. The animal waste disposal system 100 includes a waste removal tool 200, which is preferably formed from a single sheet of flexible, semi-rigid material, such as, for example, heavy paper, cardboard, thermoplastic material or the like. The waste removal tool 200 preferably includes a pair of opposing jaws 210 that are separated by a central or intermediate portion 220. A fold or score line 222 is provided between each jaw 210 and the intermediate portion 220 to permit movement of the jaw 210 relative to the intermediate portion 220.

Each jaw 210 preferably terminates in an upstanding blade portion 210*a* for urging animal waste into the waste removal tool 200 as the opposing jaws 210 are moved closer to one another. The sides of each jaw 210 preferably terminate in an upstanding sidewall 210*b*. A handle or strap 240 to facilitate and ease use by a user may be attached to each opposing jaw 210 in a conventional manner, such as, for example, using an adhesive, fasteners, staples or the like.

A collection bag 230 is used with the waste removal tool 200 to collect and dispose of animal waste. The bag 230 includes a closed end or bottom 231 joined by sidewalls 232. The sidewalls 232 extend from the closed end 231 and terminate at an open end 233 to provide an internal compartment capable of holding animal waste. The collection bag 230 may be made of a thin, flexible sheet of plastic or similar material, preferably a biodegradable plastic material.

In use, the waste removal tool 200 is lined with the collection bag 230 by inserting the closed end 231 of the collection bag 230 within the opening between the opposed jaws 210 so that the closed end 231 abuts or is in proximity to the intermediate portion 220, as illustrated in FIG. 4. The collection bag 230 is then partially inverted or turned inside out so that at least a portion of the sidewalls 232 enclose the waste removal tool 200.

As illustrated in FIG. 5, the user would preferably grasp the waste removal tool 200 in the user's hand between the user's fingers and thumb. For ease of use, the user may grasp the waste removal tool 200 by inserting one or more of the user's fingers within the handle or strap 240 attached to one of the jaws 210 and inserting the user's thumb within the handle or strap 240 attached to the other jaw 210.

The user may collect animal waste by opening the user's hand to separate the jaws 210 of the waste removal tool 200 so that open end 233 of the collection bag 230 within the opposing jaws 210 surrounds the animal waste. As the user squeezes the waste removal tool 200 between the user's fingers and thumb, the opposing jaws 210 close or otherwise move closer to one another (as illustrated in FIG. 5) and the blade portions 210*a* urge or otherwise scoop the animal waste further into the collection bag 230 within the waste removal tool 200 as the jaws 210 are moved toward one another.

Once the animal waste is captured between the opposing jaws 210 lined with the collection bag 230, the collection bag 230 is then returned to its uninverted position so that the open end 233 of the collection bag 30 containing the animal waste may then be sealed, tied or otherwise closed. Releasing or otherwise allowing the opposing jaws 210 to separate allows for removal of the collection bag 230 from the waste removal tool 200. The collection bag 230 containing the animal waste may be removed from the waste removal tool 200 prior to or after sealing the open end of the bag. The collection bag 230 containing the animal waste may then be thrown away or otherwise disposed of and another collection bag may be used with the waste removal tool 200.

Neither the user's hand nor fingers come into contact with the animal waste during collection since the user's hand is protected by the collection bag 230, thereby providing a sanitary means of collecting and disposing of animal waste. Moreover, the user is not exposed to unpleasant tactile senses associated with contacting the animal waste through the bag 30 since the waste is contained within the waste removal tool 200 and does not come into contact with the user's hand.

Having described and illustrated the principles of this application by reference to one or more preferred embodiments, it should be apparent that the preferred embodiment(s) may be modified in arrangement and detail without departing from the principles disclosed herein and that it is intended that the application be construed as including all such modifications and variations insofar as they come within the spirit and scope of the subject matter disclosed herein.

What is claimed is:

1. An animal waste disposal system, comprising:

a waste removal tool having a pair of opposing jaws separated by a generally straight intermediate portion, each jaw pivotally connected to an opposing end of the intermediate portion and terminating in a blade portion, the waste removal tool dimensioned to fit within the palm of a user's hand with the user's fingers extending over one of the jaws and the user's thumb extending over the other jaw;

the opposing jaws being movable in response to movement of the user's fingers and thumb from an open position where the jaws are separated from one another to a closed position where the blade portion of one opposing jaw is in close proximity to the blade portion the other opposing jaw, the waste removal tool generally forming an isosceles trapezoidal configuration when viewed from a side in the closed position; and a collection bag having an open end and a closed bottom.

2. The animal waste disposal system according to claim 1, wherein the closed bottom of the collection bag is positioned within the opposing jaws.

3. The animal waste disposal system according to claim 1, wherein the waste removal tool is attached to the closed bottom of the collection bag.

4. The animal waste disposal system according to claim 3, wherein the waste removal tool is substantially V-shaped.

5. The animal waste disposal system according to claim 1, wherein each jaw includes opposing upstanding sidewalls that are each contiguous with an edge of the blade portion.

6. The animal waste disposal system according to claim 1, wherein the waste removal tool is made from a single sheet of flexible material that is folded to permit movement of the opposing jaws relative to one another.

7. The animal waste disposal system according to claim 1, wherein the waste removal tool is made from cardboard.

8. The animal waste disposal system according to claim 1, wherein the waste removal tool is made from heavy paper.

9. The animal waste disposal system according to claim 1, wherein the waste removal tool is made from plastic.

10. The animal waste disposal system according to claim 1, wherein the bag is made from plastic.

11. The animal waste disposal system according to claim 10, wherein the bag is biodegradable.

12. An animal waste disposal system, comprising:

a waste removal tool having a pair of opposing jaws separated by a generally straight intermediate portion, each jaw pivotally connected to an opposing end of the intermediate portion and terminating in a blade portion, the waste removal tool dimensioned to fit within the palm of a user's hand with the user's fingers extending over one of the jaws and the user's thumb extending over the other jaw;

the opposing jaws being movable in response to movement of the user's fingers and thumb from an open position where the jaws are separated from one another to a closed position where the blade portion of one opposing jaw is in close proximity to the blade portion the other opposing jaw, the waste removal tool generally forming an isosceles trapezoidal configuration when viewed from a side in the closed position; and a first handle on one of the opposing jaws for receiving a user's fingers and a second handle on the other opposing jaw for receiving the user's thumb.

* * * * *